United States Patent [19]

Wada

[11] Patent Number: 5,044,793

[45] Date of Patent: Sep. 3, 1991

[54] HAMMER DEVICE HAVING ADJUSTABLE STRIKING FORCE

[75] Inventor: Toshihide Wada, Yokohama, Japan

[73] Assignee: Canon Kabushiki Kaisha, Tokyo, Japan

[21] Appl. No.: 481,692

[22] Filed: Feb. 20, 1990

Related U.S. Application Data

[63] Continuation of Ser. No. 370,122, Jun. 20, 1989, abandoned, which is a continuation of Ser. No. 124,446, Nov. 23, 1987, abandoned, which is a continuation of Ser. No. 935,128, Nov. 26, 1986, abandoned, which is a continuation of Ser. No. 827,673, Feb. 10, 1986, abandoned, which is a continuation of Ser. No. 625,640, Jun. 28, 1984, abandoned.

[30] Foreign Application Priority Data

Jul. 8, 1983 [JP] Japan ..... 58-123465

[51] Int. Cl.[5] ..... B41J 9/44

[52] U.S. Cl. ..... 400/157.3; 400/144.2; 101/93.03

[58] Field of Search ..... 400/53, 144.2, 144.3, 400/157.2, 157.3, 163.1, 166, 167; 101/93.02, 93.03, 93.29, 93.34, 93.48; 267/136, 140.2; 335/257, 258, 273

[56] References Cited

U.S. PATENT DOCUMENTS

| | | | |
|---|---|---|---|
| Re. 29,745 | 8/1978 | Gomi | 101/93.29 |
| 3,900,094 | 8/1975 | Larsen et al. | 101/93.05 X |
| 3,964,384 | 6/1976 | Johnston | 101/93.02 X |
| 4,308,794 | 1/1982 | Adamoli et al. | 101/93.03 |
| 4,491,069 | 1/1985 | Kawahara | 101/93.03 |
| 4,569,607 | 2/1986 | Takemoto | 400/167 |
| 4,603,985 | 8/1986 | Helinski et al. | 400/167 |

FOREIGN PATENT DOCUMENTS

| | | | |
|---|---|---|---|
| 0065620 | 12/1982 | European Pat. Off. | 101/93.34 |
| 123487 | 9/1980 | Japan | 101/93.29 |

OTHER PUBLICATIONS

Xerox Disclosure Journal, "Hammer Rebound Retention", by Frechette, vol. 1, No. 4, Apr. 1976, p. 23.

*Primary Examiner*—David A. Wiecking

*Attorney, Agent, or Firm*—Fitzpatrick, Cella, Harper & Scinto

[57] ABSTRACT

A hammer device generates a magnetic moving force in a magnetic member by energizing a coil, whereby a hammer strikes a recording sheet to form a record thereon by means of its moving force, the striking force of the being capable of regulation by changing the relative position of the coil and the magnetic member without changing the position of the hammer.

15 Claims, 3 Drawing Sheets

HAMMER DEVICE HAVING ADJUSTABLE STRIKING FORCE

This application is a continuation of application Ser. No. 370,122 filed June 20, 1989, which is a continuation of Ser. No. 124,446 filed Nov. 23, 1987, which is a continuation of Ser. No. 935,128 filed Nov. 26, 1986, which is a continuation of Ser. No. 827,673 filed Feb. 10, 1986, which is a continuation of Patent application Ser. No. 625,640 filed June 28, 1984, all now abandoned.

BACKGROUND OF THE INVENTION

1. Field of the Invention

The present invention relates to a hammer device in which a hammer is moved to strike a recording sheet by attraction of an armature with a coil.

2. Description of the Prior Art

In the field of electronic typewriters and computer terminal printers, there are already employed impact printers in which a magnetic force obtained by energizing a coil is used for displacing a movable hammer toward a platen, thereby causing a type to strike a printing sheet on the platen through an ink ribbon to print on the sheet.

In such impact printers, the printed characters will not be uniform unless types of smaller areas exert a weaker striking force while types of larger areas exert stronger striking force.

In order to prevent such drawback there have been made various proposals, but such proposals invariably involve excessive complication in structure or in control.

Also there is required an exact positional adjustment among the hammer, coil and yoke in order to obtain the above-mentioned characteristic of the hammer, but such adjustment is generally extremely difficult and is scarcely achievable in uniform manner on all units.

SUMMARY OF THE INVENTION

An object of the present invention is to provide a hammer device in which the striking force is easily adjustable.

Another object of the present invention is to prevent noise or repeated advancement of the hammer when the hammer is returned.

Still another object of the present invention is to provide a printing apparatus in which the striking force of the hammer is easily adjustable.

BRIEF DESCRIPTION OF THE DRAWINGS

The attached drawings illustrate an embodiment of the present invention, wherein.

DETAILED DESCRIPTION OF THE PREFERRED EMBODIMENTS

Now the present invention will be clarified in detail by an embodiment shown in the attached drawings.

Figure 1:
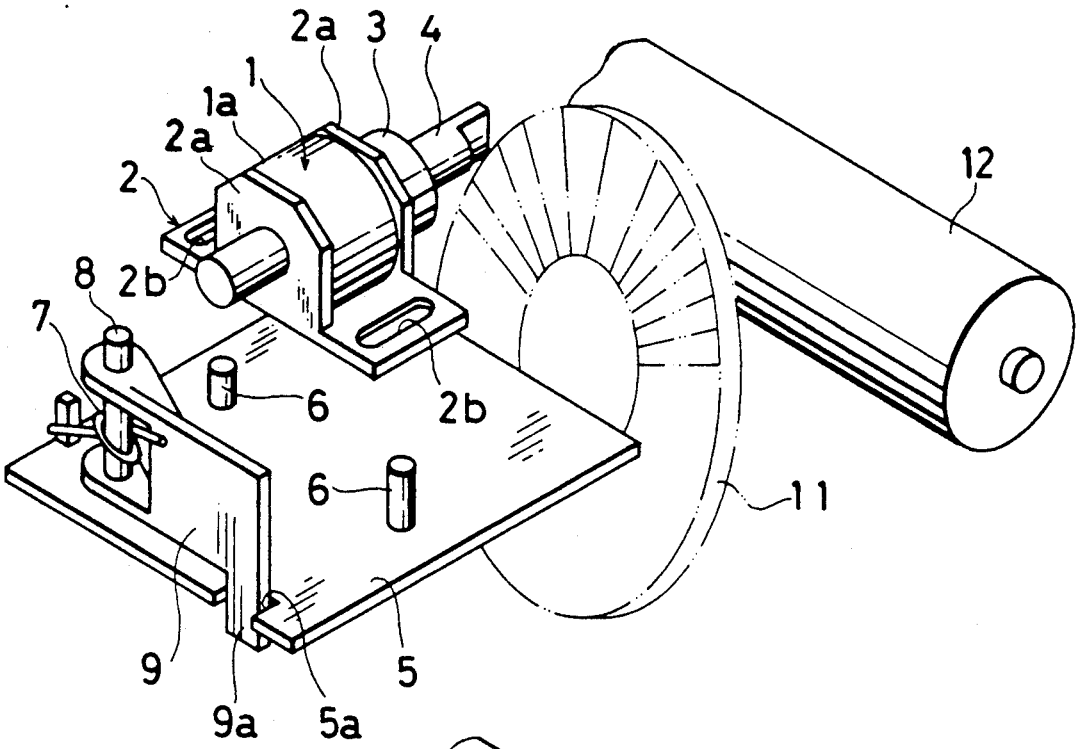
FIG. 1 is a perspective view of a hammer unit before it is mounted on a base.
Figure 2:
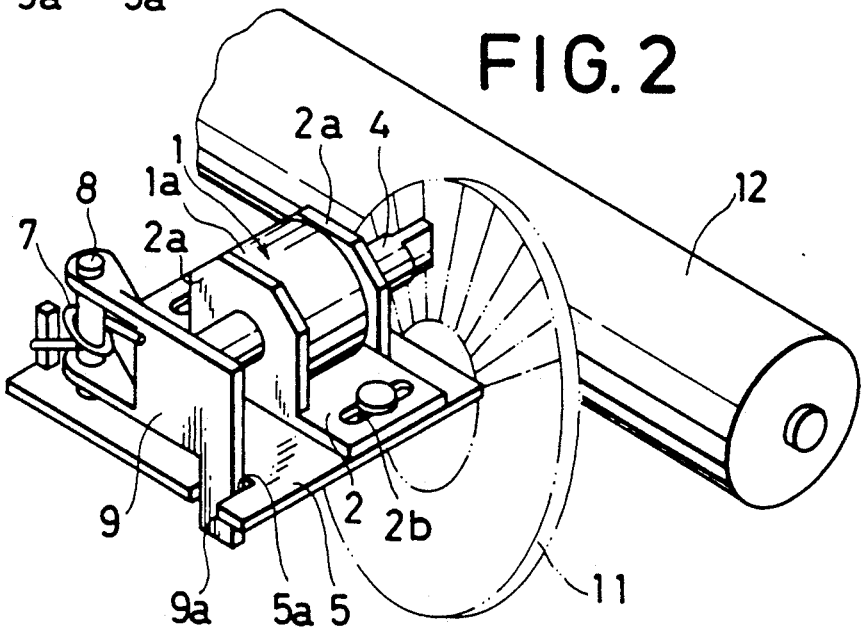
FIG. 2 is a perspective view of the hammer unit mounted on the base.

FIGS. 1 and 2 show a hammer unit respectively before and after it is mounted on a base functioning as a support member therefore. The hammer device of the present invention is composed of the hammer unit and the base integrally connected thereto, and a printing apparatus is composed of the hammer device and other components such as a platen, a type font wheel, etc. to be explained later.

In FIGS. 1 and 2, the hammer unit 1 is assembled on a support frame 2.

The support frame 2 is provided, at the front and rear part thereof, with support plates 2*a*, 2*a* between which is positioned a coil 1*a*, and a cylindrical hammer 4 is slidably fitted in the center of the coil 1*a*.

There is also provided a yoke 3. On both ends of the support frame 2 there are formed elongated slots 2*b* which are disposed parallel to the hammer 4 and are respectively fitted with guide pins 6, 6 projecting from a base 5. As will be explained later, the elongated slots 2*b* and guide pins 6, 6 allow regulation of the relative position of the coil 1*a* with respect to the hammer 4 and a magnetic member 4*a*, seen in FIG. 3, fixed on the rear end thereof.

From the base 5 projects a shaft 8 on which a rotatable lever 9 is rotatably supported at an end thereof. The lever 9 engages with the rear end of the magnetic member 4*a* and functions as a stopper for stopping the magnetic member 4*a* and the hammer 4 at a determined position. The rotatable lever 9 is provided, at the free end thereof, with an elongated finger 9*a* which is extended toward the base 5 and engages with a recess 5*a* formed at the rear end of the base 5.

The shaft 8 is provided thereon with a torsion coil spring 7 for biasing the rotatable lever 9 counterclockwise in the drawing. In this manner the rotatable lever 9 resiliently receives the rear end of the magnetic member 4*a* to stop the magnetic member 4*a* and the hammer 4 at a determined home position. Thus, since the hammer is resiliently received by the rotatable lever 9 when returned to its home position, the impact force is decreased and the impact noise reduced.

Figure 3A:
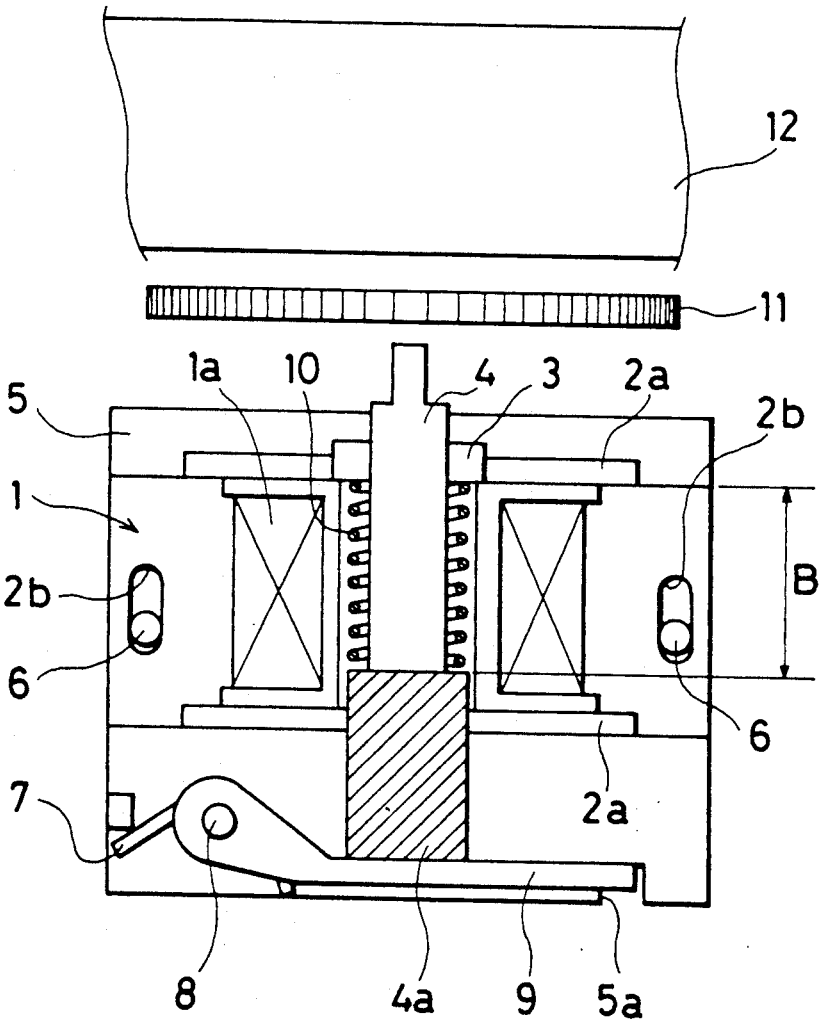
FIGS. 3A and 3B are cross-sectional plan views showing the method of adjusting the output power of the hammer.
Figure 3B:
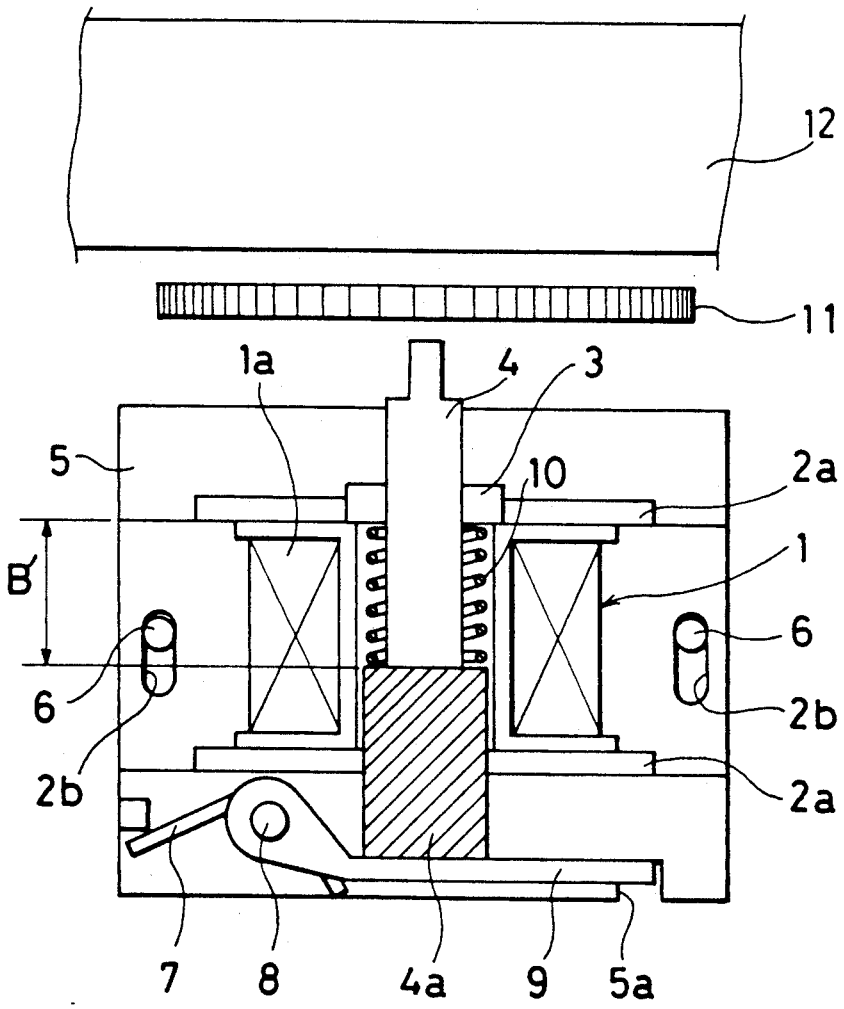

As shown in FIGS. 3A and 3B, the hammer 4 composed of a non-magnetic material such as stainless steel is provided at the rear end thereof with the magnetic member 4*a* composed of a magnetic material such as soft steel, and between the magnetic member 4*a* and the yoke 3 there is provided a returning spring 10 to constantly bias the hammer 4 in the retracted position.

The torsion coil spring 7 and the spring 10 are so selected that the finger 9*a* of the rotatable lever 9 remains in the recess 5*a* of the base 5 in the normal state and in a state when the hammer unit 1 is displaced on the base toward the rotatable lever 9 until the pins 6, 6 are in contact with the end portions of the elongated slots 2*b*.

In the above-described hammer unit, the magnetic flux generated by energizing the coil 1*a* functions to magnetically attract the magnetic member 4*a* to the yoke 3 against the force of the spring 10, and the magnetic attraction causes the hammer 4 to project to the front. In front of the hammer 4 there is rotatably provided a so-called daisy type font wheel 11 having a printing type on the front end of each spoke. Further in front of the daisy wheel 11 there is provided a platen 12 bearing printing sheet (not shown) thereon. In the abovedescribed structure, upon energization of the coil 1*a*, the hammer 4 causes the type to strike the recording sheet, thus to generate a print thereon.

The hammer unit 1 is fixed on the base 5 by fitting the guide pins 6, 6 in the elongated slots 2*b* of the support frame 2 and fixing nuts (not shown) or the like on the threaded guide pins 6.

Consequently the hammer unit 1 is positionally adjustable front and back within the length of the elongated slots 2*b*, with respect to the base 5. The adjustment within the range of pins 6,6 and slots 2*b*,2*b* does not change the relation of the forces provided by springs 7 and 10. More detailedly, such positional adjustment does not alter the position of the hammer 4 with respect to the font wheel 11 but alters the relative position of the magnetic member 4*a* with respect to the coil 1*a*. Consequently it is rendered easily possible to regulate the striking force of the hammer without moving the same.

In the assembled state as shown in FIGS. 3A and 3B, the rear end of the magnetic member 4*a* provided at the rear end of the hammer 4 is maintained in contact with a lateral face of the rotatable lever 9 which is constantly biased by the torsion coil spring 7.

Also in such state, the rotary force of the torsion coil spring 7 on the rotatable lever 9 is larger than the elastic force of the returning spring 10, so that the finger 9*a* always sits in the recess 5*a* of the base 5 without displacement of the lever 9.

In the above-described structure, when the coil 1*a* is energized according to print instructions, there is generated a magnetic field in a direction to move the magnetic member 4*a* of the hammer 4 toward the platen 12, whereby the hammer 4 performs a forward movement to strike the type font wheel 11, thus impacting against the platen 12 on the unrepresented recording sheet and printing through an ink ribbon.

Since the hammer unit 1 engages, in the aforementioned manner, with the guide pins 6, 6 through the elongated slots 2*b* and is movable within the length thereof while the returning spring 10 constantly biases the hammer 4 in such a manner that the rotatable lever 9 is in contact with the magnetic member 4*a*, the distance B between the front end of the magnetic member 4*a* and the yoke 3 is arbitrarily adjustable without any change in the relative positional relationship between the hammer 4 of the hammer unit and the rotatable lever 9.

The distance B affects the attractive force on the hammer when the coil 1*a* is energized.

If the distance B is selected small as indicated by B' in FIG. 3B, the hammer 4 can be activated even with a small energizing current. On the other if the distance is selected large as shown in FIG. 3A, the hammer 4 does not perform the printing operation unless a relatively large energizing current is supplied.

Thus the printing force of the hammer 4 can be adjusted by regulating the position of the hammer unit 1 with respect to the base 5.

In practice the printing force can be quite easily adjusted since the printing force can be regulated by the measurement of the output power of the hammer.

In the foregoing embodiment the hammer unit 1 has an integral structure including the support frame and the coil, but it is possible also to render the coil (including the yoke) movable with respect to the support frame 2, and permanently fix the support frame to the base. In such case the unrepresented support member of the coil can be made movable with respect to the support frame 2 or to the base 5 through the combination of elongated holes and guide pins.

In the foregoing embodiment the hammer 4 is composed integral with the magnetic member 4*a*, but it is also possible to separate the hammer from the magnetic member 4*a*. Also the hammer need not necessarily be cylindrical but may assume other forms such as a wire-shape. It will further be evident that the present invention is subject to various other modifications.

What I claim is:

1. An impact printer comprising:

printing means having a printing type for printing;

hammer means including a hammer member for striking said printing type to make a record on a recording sheet, wherein said hammer member is formed in a bar shape along a striking direction;

actuating means for actuating said hammer means to move toward and away from said printing means, including a coil for generating a magnetic moving force to generate a striking force by energizing said coil and a spring member having a resilient force opposing the striking force;

a magnetic member, integrally connected with said hammer member in series in the striking direction of said hammer member, for moving said hammer member in the striking direction by means of the moving force generated by said coil, wherein said coil and said spring member have an opening through which said hammer means is slidably inserted, with said spring member applying a resilient force of variable magnitude to said magnetic member, and said magnetic member is attracted by said coil in order to move said hammer means toward said printing means, and wherein said magnetic member is formed in a bar shape;

a first support member having a plurality of first regulating means for regulating the relative position of said first support member, and a second support member supporting at least said coil and said hammer means, wherein said second support member comprises a plurality of second regulating means at the positions corresponding to said first regulating means of said first support member, with said first regulating means being movable in relation to said second regulating means for manually regulating said variable magnitude resilient force applied against said magnetic member, and surfaces of said first and second support members are planar and said first support member is kept in contact with said second support member through plane surfaces of said first support member and said second support member, and wherein said hammer member is free to move relative to said second support member and said second regulating means is provided on opposite sides of the path of said hammer member; and stopper means, arranged on said first support member resiliently in contact with said magnetic member, for supporting an end portion of said magnetic member, wherein said moving force is adjusted by shifting said second support member in the striking direction by regulating said resilient force by means of said first and second regulating means.

2. An impact printer according to claim 1, wherein said first regulating means is formed in shape of a projection.

3. An impact printer according to claim 1, wherein said stopper means is supported at said first support member via a shaft.

4. An impact according to claim 1, wherein said second regulating means comprises a plurality of slots formed at said plane of said first support member, and said first regulating means comprises plurality of projections, fitting into said slots formed at said plane of said second member.

5. An impact printer according to claim 1, wherein said variable magnitude resilient force is manually regulated by regulating a relation between said moving force generated by said coil and said resilient force, so as to regulate said striking force.

6. An impact printer according to claim 1, wherein said variable magnitude resilient force is manually regulated to regulate said striking force.

7. An impact printer according to claim 1, wherein said second regulating means comprises a plurality of slots formed at said plane of said first support member, with said slots being parallel to each other, and said first regulating means comprises projections, fitting into said slots, formed at said plane of said second support member.

8. A hammer device for striking a printing type, comprising:

a coil for generating a magnetic moving force in a magnetic member by energizing the coil, wherein said magnetic member is formed in a bar shape;

stopper means maintained in contact with one end of said magnetic member to determine a stop position of said magnetic member, wherein said stopper means is rotatably supported about a shaft;

first biasing means for resiliently holding said stopper means at a determined position in contact with a fixed part to bias said magnetic member in one direction;

hammer means provided at another end of said magnetic member in the striking direction thereof, for striking the printing type to make a record on a recording paper by means of the moving force generated by said coil, wherein said coil has an opening through which said hammer means is slidably inserted and said magnetic member is attracted by said coil in order to move said hammer means to print;

second biasing means for applying a resilient force of variable magnitude to said magnetic member in another direction, with said resilient force being weaker than that provided by said first biasing means in such a manner that said magnetic member is maintained in contact with said stopper means; and a first support member including said first biasing means, said stopper means and a plurality of first regulating means for regulating the relative position of said first support member and a second support member while keeping the variable resilient force weaker than the force of said first biasing means, wherein said second support member comprises a plurality of second regulating means at the positions corresponding to said first regulating means of said first support member, said first regulating means movable in relation to said second regulating means for manually regulating said variable magnitude resilient force, and surfaces of said first and second support members are planar and said first support member is kept in contact with said second support member through planar surfaces of said first support member and second support member and wherein said second support member supports said coil, said hammer means and said second biasing means, with said coil and said second biasing means having an opening through which said hammer means is slidably inserted, said hammer means is free to move relative to said second support member and said plurality of first and second regulating means are provided on both sides of the path of said hammer means, wherein said stopper means is mounted on said first support member and positioned in the striking direction of said hammer means such that said stopper means, said magnetic member and said hammer means are arranged in a series, wherein said hammer means is formed in a bar shape along said striking direction and wherein said moving force is adjusted by shifting said second support member in the striking direction by means of said first and second regulating means.

9. A hammer device according to claim 8, wherein said first and second regulating means regulates the striking force of said hammer means by changing the relative position of the coil and the magnetic member, the relative position being changed by means of the difference in force between said first biasing means and said second biasing means.

10. A hammer device according to claim 8, wherein said first and second biasing means each comprise a spring.

11. A hammer device according to claim 8, wherein said variable magnitude resilient force is manually regulated by regulating a relation between said moving force generated by said coil and said resilient force.

12. A hammer device according to claim 8, wherein said second regulating means comprises a slot formed at said plane of said first support member, and said first regulating means comprises a projection, fitting into said slot, formed at said plane of said second support member.

13. A hammer device according to claim 8, wherein said second regulating means comprises a plurality of slots formed at said plane of said first support member, with said slots being parallel to each other, and said first regulating means comprises projections, fitting into said slots, formed at said plane of said second support member.

14. A hammer device according to claim 8, wherein said first regulating means is formed in shape of a projection.

15. A hammer device according to claim 8, wherein said stopper means is supported at said first support member via a shaft.

* * * * *

UNITED STATES PATENT AND TRADEMARK OFFICE

CERTIFICATE OF CORRECTION

PATENT NO. : 5,044,793 Page 1 of 2

DATED : September 3, 1991

INVENTOR(S) : Toshihide Wada

It is certified that error appears in the above-identified patent and that said Letters Patent is hereby corrected as shown below:

ON THE TITLE PAGE, [56] REFERENCES CITED

FOREIGN PATENT DOCUMENTS, insert: --60-120076 6/1985 Japan--.

[57] ABSTRACT

Line 5, "the being" should read --the hammer being--.

COLUMN 3:

Line 48, "other if" should read --other hand, if--.

COLUMN 4:

Line 66, "impact" should read --impact printer--.

COLUMN 5:

Line 2, "slots" should read --slots,--.

Line 3, "second member." should read --second support member.--.

UNITED STATES PATENT AND TRADEMARK OFFICE

CERTIFICATE OF CORRECTION

PATENT NO. : 5,044,793

DATED : September 3, 1991

INVENTOR(S) : Toshihide Wada

It is certified that error appears in the above-identified patent and that said Letters Patent is hereby corrected as shown below:

COLUMN 6:

Line 26, "regulates" should read --regulate--.

Signed and Sealed this

Twenty-seventh Day of April, 1993

*Attest:*

MICHAEL K. KIRK

*Attesting Officer*

*Acting Commissioner of Patents and Trademarks*